United States Patent [19]

Blee

[11] Patent Number: 5,031,556

[45] Date of Patent: Jul. 16, 1991

[54] MARINE HULL

[76] Inventor: Leonard J. Blee, 66 Leslie Avenue, Blair Athol, South Australia 5084, Australia

[21] Appl. No.: 461,346

[22] Filed: Jan. 5, 1990

Related U.S. Application Data

[63] Continuation-in-part of Ser. No. 263,702, Oct. 28, 1988, abandoned, which is a continuation-in-part of Ser. No. 120,075, Nov. 13, 1987, abandoned.

[30] Foreign Application Priority Data

Nov. 18, 1986 [AU] Australia ..... PH9019

[51] Int. Cl.[5] ..... B63B 1/00

[52] U.S. Cl. ..... 114/56; 114/288; 114/290

[58] Field of Search ..... 114/56, 62, 67 A, 288–290, 114/271, 197; 440/68–70

[56] References Cited

U.S. PATENT DOCUMENTS

| | | | |
|---|---|---|---|
| 1,050,517 | 1/1913 | Chase | 114/290 |
| 1,824,313 | 9/1931 | Vogler | 114/67 A |
| 4,689,026 | 8/1987 | Small | 440/66 |

*Primary Examiner*—Ed Swinehart
*Attorney, Agent, or Firm*—Rodman & Rodman

[57] ABSTRACT

The marine hull has a forebody, a transom, and a bottom extending therebetween having pairs of upwardly formed channels between the forebody and the transom. The channels of each pair diverge rearwardly. Fluid flow exit paths interrupt the channel walls so that fluid from some of the channels can flow laterally outwardly, and the rear ends of at least some of the channels open at a peripheral edge of the bottom whereby water in these channels is free to discharge in both a rearward and laterally outward direction.

18 Claims, 6 Drawing Sheets

MARINE HULL

This is a continuation-in-part of application Ser. No. 263,702 filed on Oct. 28, 1988 which was a continuation-in-part of application Ser. No. 120,075 filed Nov. 13, 1987, both now abandoned.

This invention relates to improvements in a marine hull, and is not necessarily limited to high speed hulls but the invention is particularly applicable thereto.

BACKGROUND OF THE INVENTION

The most commonly used planing hulls for marine purposes have substantially constant dead rises aft of about station 4 or 5, in order to reduce the suction load which can occur with a "hooked" style of hull bottom. With a constant dead rise however the loading between the surface of the hull bottom and the water is usually positive for most of the length of the hull (that is, there is a kinetic energy imparted to the water due to deflection of the particles of water encountered by the hull bottom surface, having a downward component of movement). The trim angle is therefore critical. The pressure pattern however is much higher towards the forebody end of the hull than it is towards the aft end, and consequently most of the dynamic forces which are of use to the hull in ocean-going conditions occur over a relatively short length of the hull, probably not more than 15%. When the dynamic forces are relied upon (as in the usual case), the loading on the "low" side of the hull when deflected by a wave extends over a wider area and the loading on the "high" side extends over a lesser area, thereby establishing a righting force, but over a short length of hull only. It is believed this is one of the limiting features of the standard constant dead rise type of planing hull. If however the loading is more evenly spread over the whole area of the hull, the difference is very much greater and there is a superior righting force.

In my U.S. Pat. No. 4,708,085 entitled "Marine Hull" there is described and claimed a marine hull wherein the shape of the bottom included channels which diverge in a rearward direction, each channel having a surface of such shape that it intercepts and deflects water when the hull is mobile, causing the water so intercepted and deflected to move upwardly and rearwardly with respect to the hull, and then be deflected downwardly by the concave surfaces of the channels and thereby imparting a vertical component of lift well aft of the normal maximum loading area. The rearmost pair of channels defined a "V" shape in plan. Experiments with seagoing craft have proved that the theories appear to be correct, and that a hull with such channels is much more stable and soft riding under rough conditions than a conventional constant dead rise mono-hull type of craft.

With most hulls known to the applicant, there is a serious tendency to pound (hydraulically bottom) as the hull leaves one wave and impacts against the next. Although this pounding effect is worst with hulls having laterally diverging bottom surfaces which are concave, it is nevertheless a serious disability with hulls having straight deadline shapes (in section) and even with those having convex deadline shapes. Even if the forebody is provided with a large dead rise angle, the pounding can still occur rearwardly of the normal area of maximum loading.

Craft made in accordance with the said Patent Application have proved that pounding is largely reduced but nevertheless there still remains a generally unresolved problem with planing hulls, and it is an object of this invention to provide further improvements whereby the tendency to pound can be substantially reduced, even further than with the hull design identified in the specification of said U.S. Pat. No. 4,708,085.

PRIOR ART

In said U.S. Patent specification, an attempt was made to reduce pounding and FIG. 8 of that specification identified, in a downwardly convex bottom, portions 28 bridging channels, the portions 28 being provided with conduits 26 which allowed air to be drawn into the channels when the hull was in motion. However, the downwardly convex surfaces tended in many instances to become high load surfaces, and the apertures were not as effectual as was at first thought.

Further, in U.S. Pat. No. 4,159,691 of Rolland K. Paxton, there was disclosed in FIG. 9 an arrangement whereby a compressor caused a flow of air to a space below the hull bottom, in an attempt to introduce compressed air into the forward ends of tunnels, but this performed an entirely different function from the function which is disclosed by this invention.

Reference may also be made to Australian Patent Specifications 434155 (52238/69) and 437551 (18243/67) in the name of Chrysler Corporation, and to U.S. Pat. Nos. 4,587,918 Burg; 4,528,292 Yoshinori; 3,316,874 Canazzi; 1,824,313 Vogler; 3,085,535 Hunt; and 1,050,517 Chase.

BRIEF SUMMARY OF THE INVENTION

In this invention a marine hull has a forebody, a transom, and a bottom extending therebetween having walls defining a plurality of upwardly formed channels between the forebody and the transom which diverge in a rearward direction, air entry means near the front ends of some of the channels, fluid flow exit paths interrupting the walls of some of the channels, and the rear ends of at least some of said channels opening at a peripheral edge of said bottom whereby water in these channels is free to discharge unhindered therefrom in a rearward and laterally outward direction.

When the front ends of the channel are located near the forebody, the downwardly facing open channels allow air to enter the channels along with the water. Where a channel is only partly submerged, the relatively low pressure area which exists beneath the hull when the hull is in motion through the water will induce a flow of air through the air entry means, or through an air flow aperture. However, as the channels undergo submersion, the motion of the hull in high sea conditions can cause considerable pounding caused by suddenly arresting forward flow of water in the channels, and this "secondary" pounding is also very objectionable, as the forces generated are spread over a large area of the hull. In this invention some of the channel walls are interrupted, by surfaces which define fluid flow paths ("exit paths") from those channels. The flow of air performs an important function of substantially reducing the suction load on the hull when the hull is moving, so that the negative effects of suction can be very substantially reduced and in some instances almost be eliminated. This is further assisted by the movement of water through the channels which also induces flow of air into the channels. There is in addition, a small reduction in the effective wetted surface because of the existence of the bubbles or particles of air. The air which is induced into the channels will provide a "cushioning" effect which is found to be extremely useful in reducing pounding when the hull is used under adverse high sea conditions.

The air performs a secondary function of allowing the water to flow upwardly into the channels and to be deflected downwardly by the channel walls. In the absence of air flow, the channels become "choked" with water which merely flows longitudinally through them, and the hull performance will be only marginally better than could be achieved with a conventional hard chine bottom.

Under some circumstances it is possible for water to enter a channel, or channels, in the hull bottom, and surge forwardly or rearwardly, to pound (hydraulically hammer) the channel walls. This most often happens with a quarter to beam sea if the hull is moving slowly through the water, and the waves are high.

The invention can further include facilities to limit this hydraulic hammering or thumping so that it is much less disturbing then that produced by present monohulls.

Firstly, exit paths exist between adjacent channels near their front ends, and if required, at some points along their length, and allow the moving water to move from lower into higher channels, from which that water can be readily redirected away from the hull. Secondly, the front ends of the channels least likely to be affected can have their exit flow paths defined by notches, which enable the water to be quickly shed from the hull surface in a lateral direction, and this in turn reduces generation of spray under rough conditions.

The arrangement appears to be far more effective than that described in said previous U.S. Pat. No. 4,708,085, and is more effective than any cushioning device otherwise known to the applicant.

The rearmost pair of channels in a hull embodying this invention are most likely to define a "V" shape in plan and open to the transom, and in an embodiment of this invention a marine hull bottom comprises walls defining an upwardly extending tunnel therein, the tunnel walls extending upwardly into the hull from the transom towards the forebody, there being at least one aperture through a said tunnel wall, said aperture being in the forward portion of that wall, and further walls within the hull defining a passageway for air flow to the aperture from within the hull. The further walls can for example be the walls of a compartment having peripheral edges sealed with respect to the hull, the location of the compartment being over the rearmost pair of channels and near or joined to the transom.

To enable suction forces to be built up at speed, a valve is fitted over the aperture to control flow of air out of the compartment. This can be a flap valve which is normally open. The valve can be operated manually to close the aperture, thus causing the hull to travel with increased draft. This can be of benefit in rough seas, improving hull stability, but at the expense of increasing drag.

The invention is applicable to most hulls wherein an hydraulic lift effect is desirable. Obviously, if there is no divergence of channels, the running lines will be straight, there will be no upward, outward and downward deflection of the water particles, and the effect of the channels would be merely to assist the hull in "tracking", this arrangement being well known.

For low speed hulls, even if they are not planing hulls, some advantage is obtained due to the dynamic lift effect, and the angle of divergence from the central longitudinal plane can be as much as 45° (90° included angle) before the benefits are less viable. On the other hand, the invention can be of value in racing craft by providing lift near the transom, sometimes with a divergence angle as little as 3°. For commonly used runabout craft, the angle of divergence can be between 15° and 20°, as herein illustrated.

Even though the channels contain air and the water therein moves freely, there is a forward component of motion imparted to the water beneath the hull by fluid friction and other factors. This applies particularly in the "V" shaped channel which opens into the transom.

In another embodiment of the invention, the walls of the "V" shaped channels increase in height rearwardly as they diverge to the transom. The intermediate surface between the channels (the upper wall of the tunnel) is desirable to be generally horizontal, and lies some height above the bottom of the craft, but nevertheless the water level in the tunnel, and the water level in the "V" shaped channels can rise above the bottom of the craft. This has the unexpected result of making it possible for an outboard propeller to operate closer to the static level of surrounding water, and in water already possessing a forward component of movement, but without ventilating ("cavitating") the propeller. There is thereby a gain in propeller efficiency, due to reduction of fluid friction for a given hull speed.

The invention is also applicable to the hull described in my aforesaid U.S. Pat. No. 4,708,085, the necessary changes being made as described below.

The invention has a number of advantages over the known prior art:

(1) Air is effectively introduced to the underside of the hull, reducing suction loads.

(2) The compartment walls function as structural members which can assist in supporting the floor of the craft which embodies the hull.

(3) When the hull is at rest, the compartment may be allowed to fill or partly fill with water artificially increasing the mass of the hull at rest so that it is less sensitive to wave motion.

(4) Since the compartment is near the aft end of the hull, the distribution of the volume of water contained therein can be a means for determining the fore and aft trim of the hull.

(5) When transducers are to be mounted in the hull, if they are mounted in that portion of the hull which is beneath the compartment walls, mounting is greatly simplified and there is no need for sealing means which may otherwise prove to be unreliable.

(6) The compartment acts as a structural member of the transom and allows forces developed by an outboard motor to be directly spread over portion of the bottom and forward areas of the hull, instead of via the transom to the sides and bottom of the hull.

(7) The compartment allows the free passage of air from holes in the transom to the apertures beneath the hull.

(8) If air is prevented from leaving the top of the compartment, then water is prevented from entering the compartment and the draught of the boat may be usefully reduced when required.

(9) Since lift is applied over a large area of the hull bottom, the trim angle can be much less than in traditional planing hulls, or even negative, yet still develop hydrodynamic lift, and this provides a great advantage when moving in rough water. Since the power requirement is directly proportional to the sine of the trim angle, there appears to be a savings in power (about 5% under average conditions), which at least partly compensates for any increase in wetted surface. Hydraulic hammering or thumping is greatly reduced.

(10) By utilising notches at the front ends of the channels, the generation of spray is limited.

BRIEF DESCRIPTION OF THE DRAWINGS

An embodiment is described hereunder in some detail with reference to and is illustrated in the accompanying drawings in which:

FIGS. 6*a*, 6*b*, 6*c* and 6*d* show a notch configuration for the forebody ends of the channels, for the fluid flow paths therefrom wherein:

FIG. 6*a* is a fragmentary perspective view as seen in the direction of arrow 6*a* in FIG. 1;

FIG. 6*b* is an enlarged fragmentary side elevation of a notch opening to the hull chine;

FIG. 6*c* is an enlarged fragmentary underside view of FIG. 6*b* in the direction of arrow 6*c;*

FIG. 6*d* is an enlarged fragmentary sectional view taken on the plane 6*d*—6*d* of FIG. 6*b;*

DETAILED DESCRIPTION OF THE PREFERRED EMBODIMENT

Figure 1:
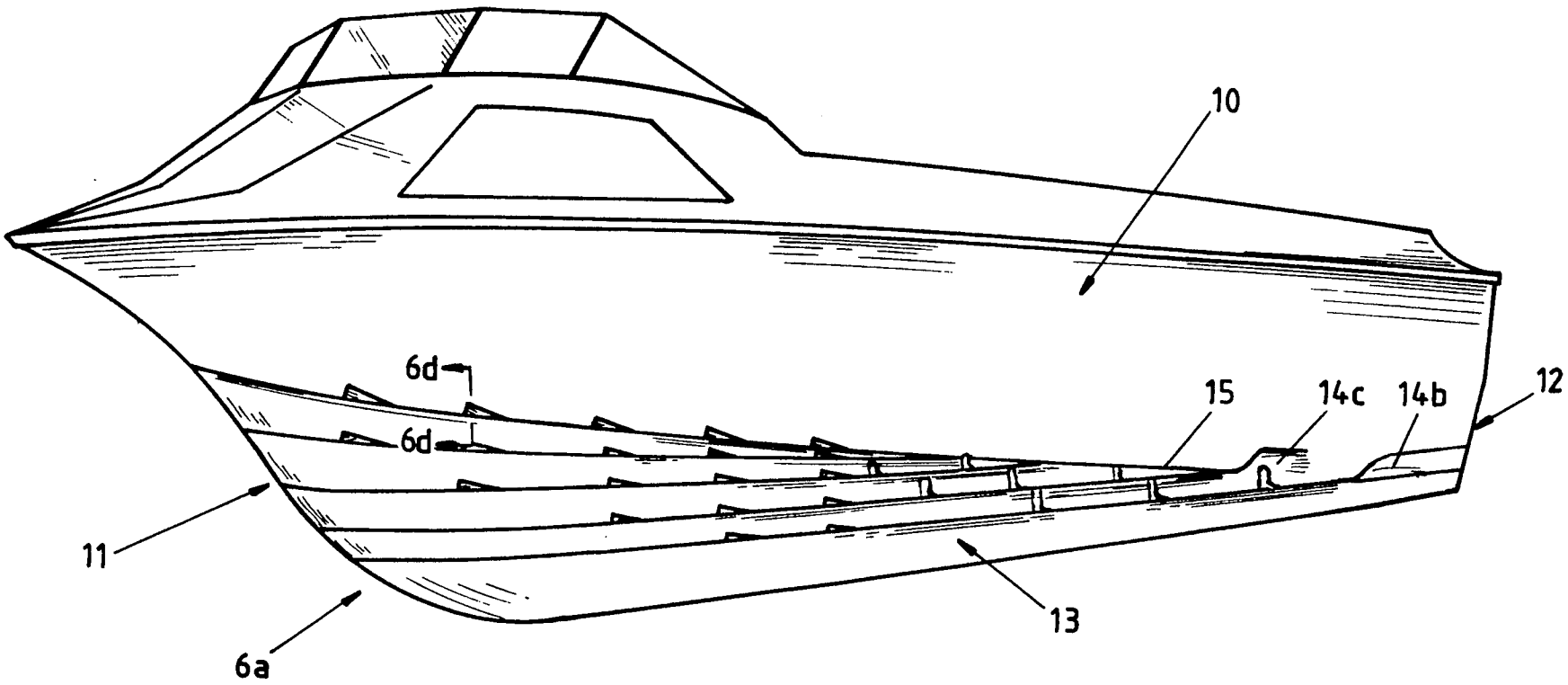
FIG. 1 is an elevational perspective view of a hull according to this embodiment.

In the drawings, only single lines are used since these are all that are required for illustrating the invention.

A hull 10 comprises a forebody 11, a transom 12, and a bottom 13 extending therebetween.

Figures 2, 3:
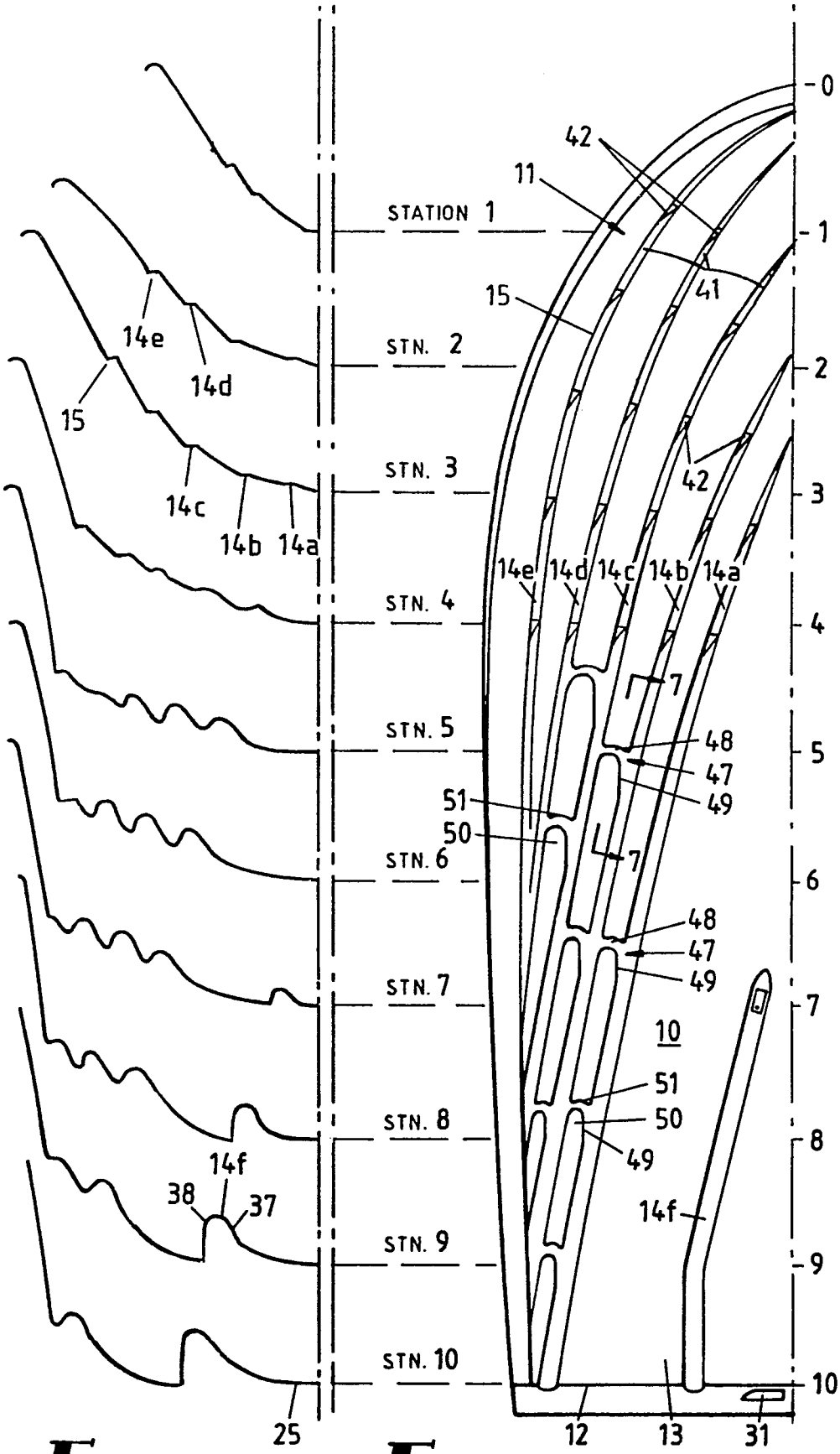
FIG. 2 is an underside view of one half of the hull illustrating channels and fluid flow paths.
FIG. 3 comprises a series of section outlines taken on stations 1 to 10 of FIG. 2.
Figure 4:
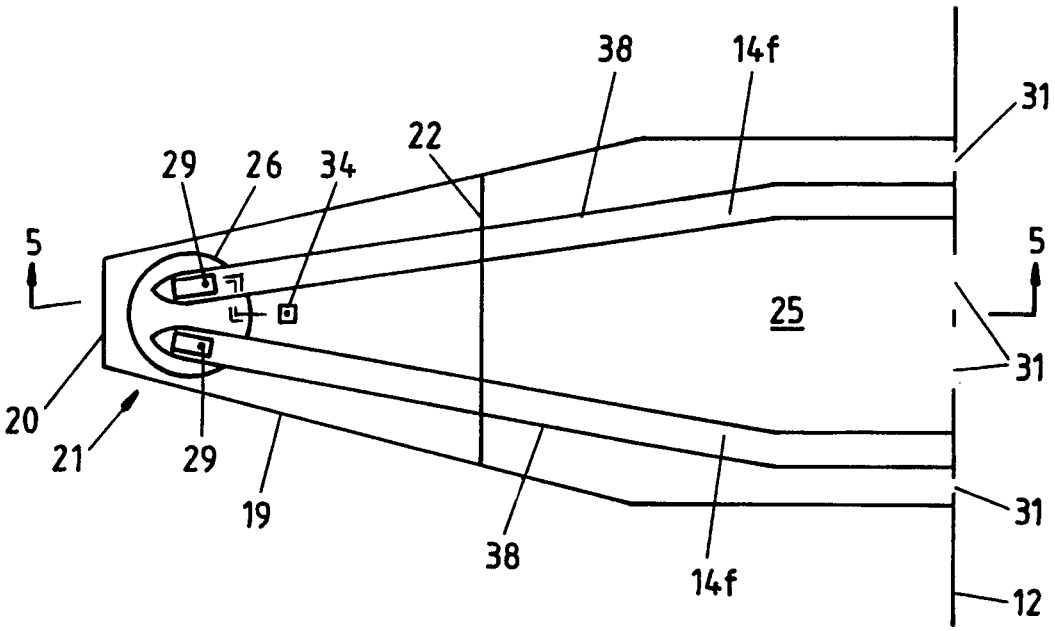
FIG. 4 is a fragmentary diagrammatic plan showing a compartment arrangement and recess walls.

The bottom 13 is provided with a plurality of channels 14*a* to 14*f* which diverge rearwardly. These channels 14 are respectively marked a, b, c, d, e and f. On each side, the two uppermost channels 14*d* and 14*e*, which are well above the waterline, comprise shallow flat shelves as seen in FIG. 3, which do not deepen and terminate part way along the hull. Intermediate channels 14*b* and 14*c* extend from the forebody 11 and open at their rear ends to the chines 15, the outer edge of channel 14*e* comprising chine 15. The inner channels 14*a* and 14*f* open to the transom 12. The channels 14*f* define a "V" shape in plan as best seen in FIGS. 2 and 4. The hull 10 has a floor 18 (FIG. 5), and a pair of side walls 19, and a front wall 20 define a compartment 21 extending forwardly into the hull from transom 12, beneath floor 18. A baffle 22 is contained within compartment 21, and extends transversely between walls 19. Baffle 22 contains a pair of spaced small apertures 23 near its upper edge and larger apertures 24 near its lower edges.

Reference is now made to FIGS. 4, 5, 8 and 9: The channels 14*f* flank a central bottom portion 25 of the hull. The front ends of channels 14*f* extend into an upstanding tube 26 which extends from bottom 13 towards floor 18, but terminates below floor 18 and within compartment 21. Within tube 26, each channel 14*f* contains an aperture 27 selectively closed by a flap valve 28, which is normally open but can be closed by an operating cable 29. The valves 28 are normally open, and can remain open for normal boat operation. At medium speed in rough weather, however, it is best for valves 28 to be both closed, and as water drains from compartment 21 quite quickly through drain holes 31, water drains from tube 26 only slowly through channels 14*f*. This inhibits resurgence of water back through drain apertures 31.

When either one of the valves 28 is closed, flow of air into respective channel 14*f* is inhibited, and a suction then occurs on that side of the boat when underway. This phenomenon is useful in effecting trim of the boat both longitudinally and laterally.

The baffle 22 inhibits rapid fore-and-aft water movement in compartment 21 and the transom 12 contains air entry apertures 32 (which can be provided with a closure valve if required) but allow air into or out of the compartment 21. An air pump 33 is effective in expelling water from compartment 21 (if required), but is useful only if the holes 31 and 32 are closable. When the hull commences motion in the water, the water contained in the rear portion of compartment 21 will quickly drain through the large apertures 31, but the air holes 23, in being small, will reduce the drainage rate through apertures 24 and 27, effectively preventing the forward part of the compartment from emptying until the rear part is empty, so that the hull will steadily gain buoyancy.

With this arrangement, the effective mass of the craft is reduced when the craft is in motion but increased when the compartment 21 is filled with water, for example, when the vessel is at rest.

In many boats, use is made of transducers, earthing plates for radios and the like, and by having for example a transducer 34 in the hull bottom but in compartment 21, the problems of sealing are removed, the transducer 34 being connected by a cable 35 to an echo sounder (not shown), through a conduit (not shown) extending upwardly above water level.

The outer side walls 38 of channels 14*f* co-operate with respective inner side walls 37 (FIG. 5) to form the pair of upwardly formed channels 14*f* in the elevated bottom portion 25. The outer side walls 38 of each channel 14*f* diverge rearwardly over a portion of their length where they initially increase in width and then run parallel to each other to the transom (FIG. 4), and increase progressively in depth in a rearward direction. They thus provide guide means which guide the exit flow of water which enters the space beneath the bottom portion 25, while the very deep rear ends of channels 14*f* are unlikely to fill with water and inhibit fluid motion.

Reference is now made to the shape and configuration of the channels 14, referred to above.

In addition to the rear channels 14*f* described in detail above, the other channels illustrated herein have varying cross-sections along their lengths as best seen from the drawings in FIGS. 2 and 3, the cross-sectional areas increasing rearwardly intermediate the channel ends.

Figure 6A:
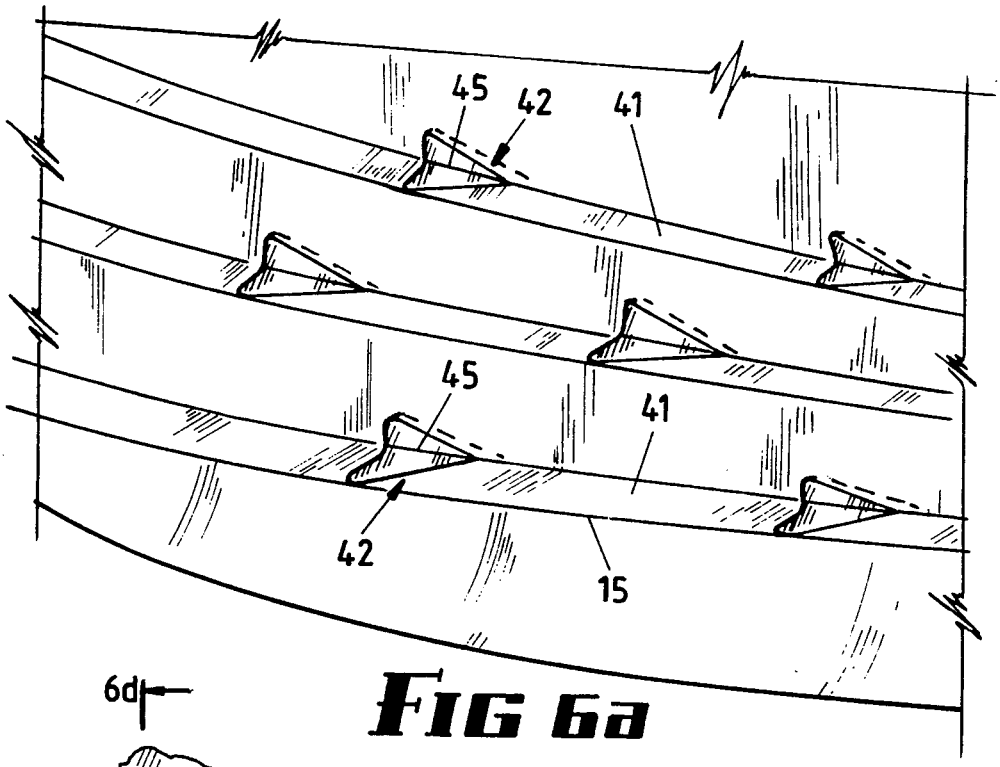
Figure 6B:
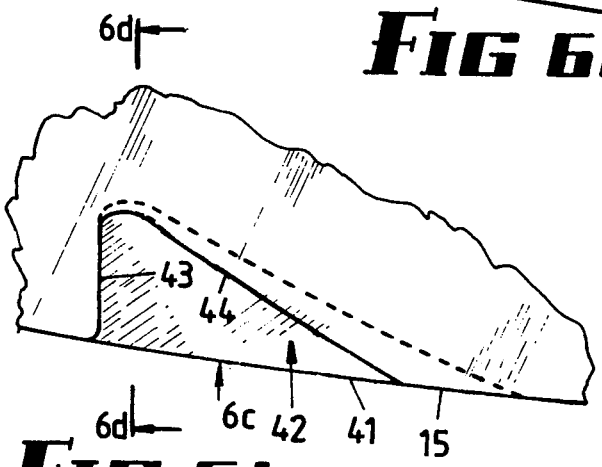
Figure 6D:
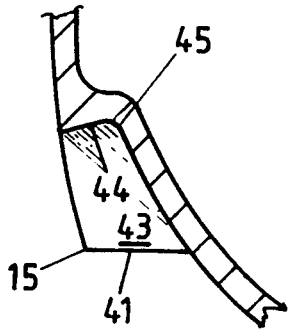
Figure 6C:
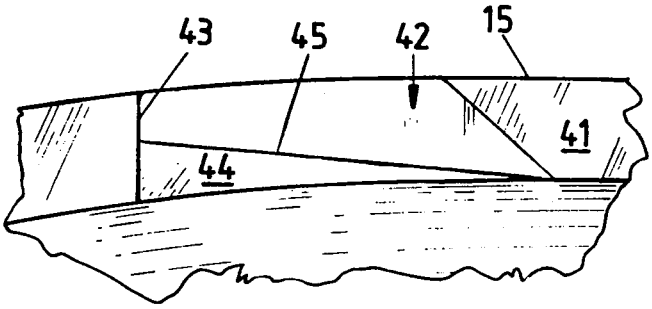

While the entrapment of air in channels is quite effective in reducing pounding, under extreme conditions pounding can still occur and it has been found that lateral deflection of water from the forebody 11 provides a very valuable means whereby pounding can be further reduced. Therefore, from station 4 forwardly (FIGS. 2, 3 and 6) the channels are narrow flow-path lands 41 which co-operate with the hull bottom to form shallow upwardly formed channels similar to the lands commonly known as "planing strakes". However when pounding occurs considerable pressure is imparted to the water surface by the forebody 11 and pounding is substantially reduced if the water is able to be easily expelled laterally along the length of the lands 41. To achieve this, there is provided a plurality of flow path walls extending laterally outwardly from some of the channels near their forward ends which define fluid flow paths to allow lateral displacement of water associated with a reduction in peak pressure and consequential reduction of pounding. These flow paths are comprised in notches 42 of generally triangular shape but shown in more detail in FIGS. 6*a*, 6*b*, 6*c* and 6*d*. The forward end of each of the lands 41 of channels 14*a*, 14*b*, 14*c*, 14*d* and 14*e* has a number of such notches, and each notch has a generally vertical forward wall 43, and from the upper part of that wall there extends a rearwardly and downwardly sloping trailing surface 44 which itself has an inverted "V" configuration as best seen in FIG. 6*d*, the apex 45 of the "V" sloping downwardly and rearwardly as seen in the underside view of FIG. 6*c*.

Figure 7:
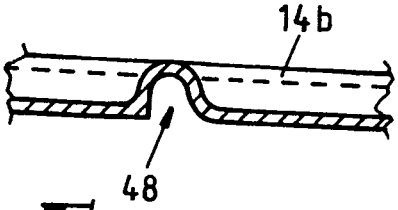
FIG. 7 is a section taken on line 7—7 of FIG. 2, but drawn to a larger scale.
Figure 8:
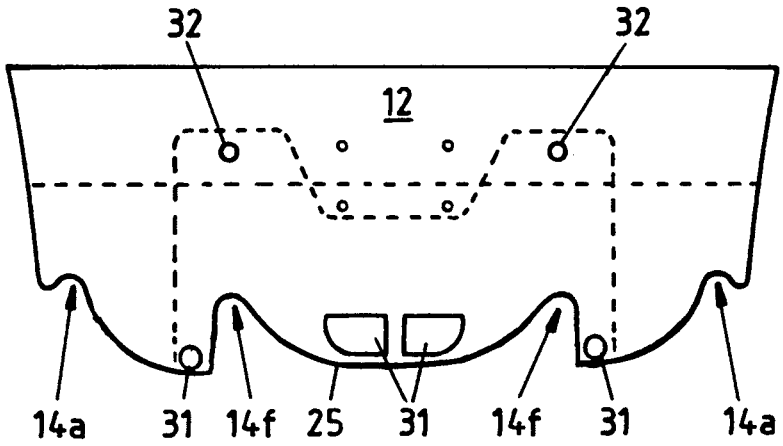
FIG. 8 is an aft end elevation of the hull of FIG. 1, showing the transom shape.
Figure 9:
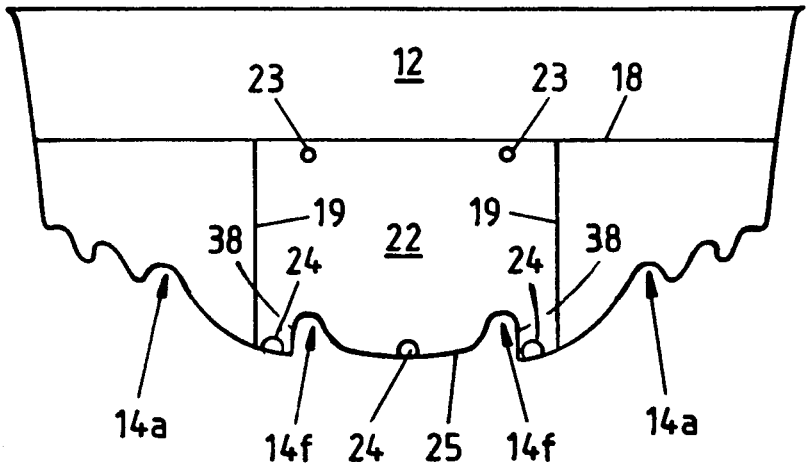
FIG. 9 is a section taken on line 9—9 of FIG. 5.

Between stations 4 and 6, each of the channels enlarges to a different cross-sectional shape best shown in FIG. 3, and it extends more deeply into the hull. These channels guide water passing through and deflect the water flow as it extends rearwardly from an upward and laterally outward flow to a downward and laterally outward flow which imparts lift to the hull rearwardly of station 5. However also towards the rear end of each channel there is need for fluid flow paths from the channels, and these fluid flow paths designated 47 comprise laterally extending channels 48 illustrated best in FIG. 7. In plan they are as shown in FIG. 2, and the inner wall of each lateral channel 48 extends for a short distance at 49 parallel to the central longitudinal plane of the hull 10.

Each front end 50 of the rearwardly extending channel walls approximates the shape of a quarter sphere, but the rearward facing walls 51 are concave in plan (FIG. 3) such that in conjunction with end 50, a non-constrictive path is formed between adjacent channels. Additional similar exit paths per channel exist further aft along each channel in some instances. The combination of the convex/concave surfaces 50/51 is effective in deflecting water laterally outwardly and rearwardly, but the rearward component is not an essential, and the laterally outward component without any rearward component can nevertheless result in an effective deflection of the water flowing through the channels.

In all instances, the channels 14 are arranged to be symmetrical with respect to a central longitudinal plane of the boat hull 10, and to diverge rearwardly at an angle thereto not less than 3° nor more than 45° (that is, 6° and 90° inclusive respectively).

Any suitably shaped hull can have its sea keeping characteristics modified by modifying the shapes and divergence of the channels. For example, more channel area near the after end will provide more dynamic lift at that end, increase the wetted area of the hull, and reduce the trim angle (requirements for ocean going vessels).

Softness of ride is increased when the trim attitude of the hull is such that the top of the front end of one or more pairs of channels is lower than the top of the rear of those channels.

By increasing the cross-section of one or more pairs of channels going from front to the rear, the top of the downwardly concave surface rises to the stern. As this reduces lift efficiency at higher speeds, this technique is best used on channels which are not constantly in contact with the water (i.e. not the lowest channel pair 14) when in motion. The channels therefore used in this embodiment are the rearmost channels 14*f*.

Figure 5:
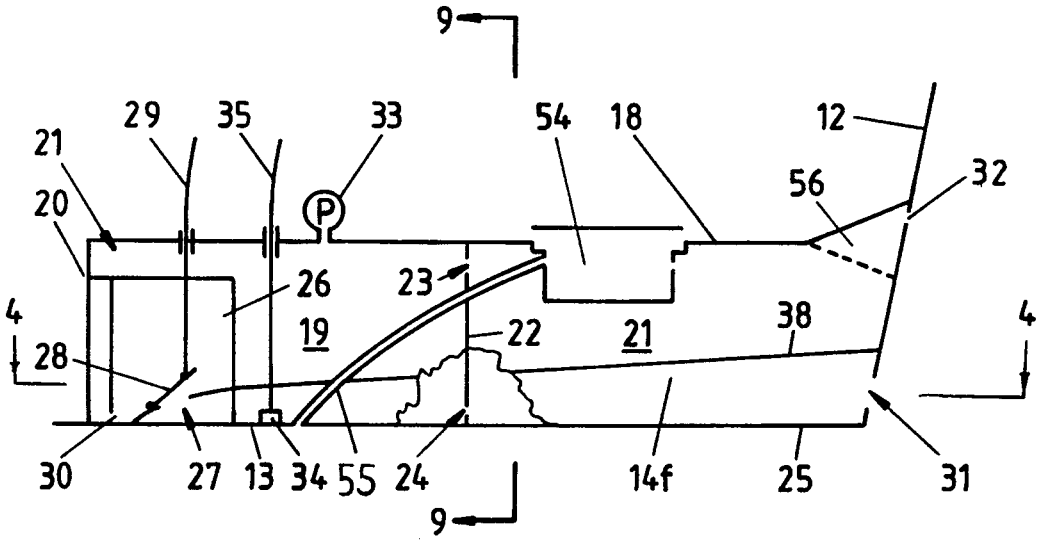
FIG. 5 is a diagrammatic elevational section taken on line 5—5 of FIG. 4, FIG. 5 also illustrating the section plane 4—4 of FIG. 4.

FIG. 5 illustrates a bait tank 54 carried by floor 18, and contained within compartment 21. Water is introduced through pick-up conduit 55, and overflows into compartment 21 and out through a drainage hole 31.

As seen best in FIG. 5, the floor 18 is stiffened at its rear end by walls 56, and the walls 56 co-operate with floor 18 and compartment walls 19 to provide a rigid structure for carrying a motor mount (not shown).

Figure 10:
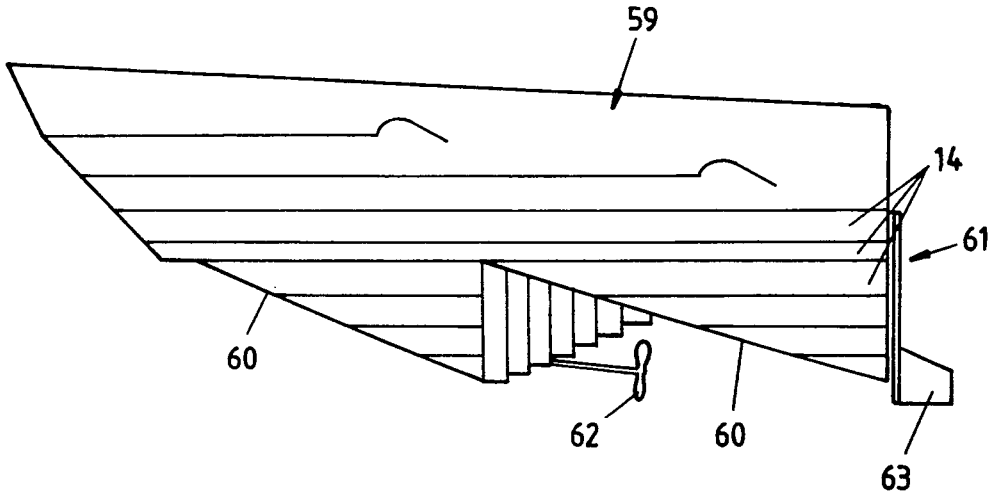
FIG. 10 is a side elevation of a hull as shown in my U.S. Pat. No. 4,708,085, modified in accordance with this invention.
Figure 11:
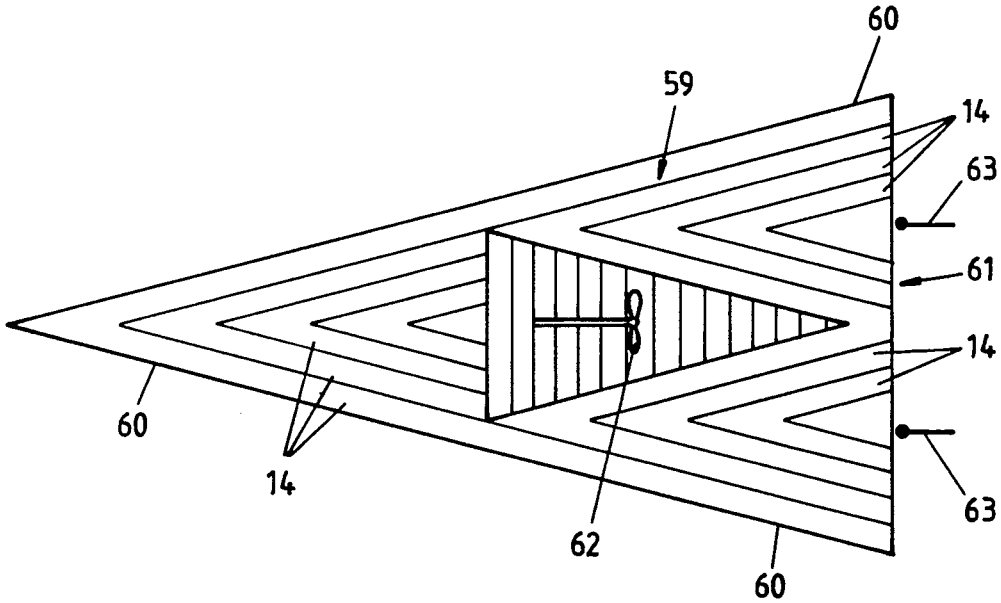
FIG. 11 is an underside view of FIG. 8.

As shown in FIGS. 10 and 11, a hull generally constructed according to an embodiment in U.S. Pat. No. 4,708,085 requires only minor modifications to achieve the benefits of this invention.

Hull 59 comprises three (or more) sub-hulls 60 each of which has a frontal surface with a plurality of rearwardly diverging channels 14 which open out to the stern end 61 of that sub-hull.

A propeller 62 (or a jet) can drive the hull 59 from the forward end, and the rudders 63 steer from the two aft sub-hulls 60. The configuration can be changed to increase the number of sub-hulls, or vary their spacing, but a hull constructed as shown can have many of the advantages of this invention.

I claim:

1. A marine hull having a forebody, a transom, and a bottom extending therebetween, the bottom comprising walls defining a plurality of upwardly formed channels between the forebody and transom which diverge in a rearward direction and open at the periphery of the bottom, the hull having a floor and side walls and an upstanding front wall co-operating with the floor, transom and a central portion of the bottom to define a compartment, the hull bottom comprising walls defining a pair of diverging channel portions which open to the transom, the upstanding wall having apertures therein and the transom having at least one aperture therein which opens into said compartment such that, when the hull is mobile at speed, air flows through the transom, through the compartment and discharges into the channel space.

2. A marine hull according to claim 1 further comprising a bait tank extending into the compartment from the floor, a pick-up conduit extending from the hull bottom to the bait tank, and a drain aperture in the bait tank for discharge of water from the bait tank into the compartment.

3. A marine hull having a forebody, a transom, and a bottom extending therebetween, the bottom comprising walls defining a plurality of upwardly formed channels arranged in pairs between the forebody and the transom, the channels of each pair diverging in a rearward direction, the upwardly formed channels including inner and lower channels, and outer and upper channels, air entry means near the forward ends of at least one said pair of channels, some of said channel walls being interrupted by forwardly and rearwardly facing walls, surfaces of some of which define fluid flow paths between the inner and lower channels and adjacent outer and upper channels, the shapes of said surfaces being such that fluid displaced from the inner and lower channels to the adjacent outer and upper channels is directed into the outer and upper channels, the aft ends of at least some of said channels opening at a peripheral edge of said bottom whereby water in those channels is free to discharge therefrom in a rearward and laterally outward direction, said marine hull further comprising a bottom portion opening rearwardly at the transom, side walls, a front wall and hull floor which combines with the hull bottom and transom to define a compartment, having at least one drain aperture, and at least one air inlet aperture above water level, the drain aperture being in a lower part of the transom located at a position which allows water to flow into the compartment when the hull is at rest but to drain from the compartment when the hull is in motion.

4. A marine hull according to claim 3 wherein at least one of said channels varies in cross-sectional area over its length.

5. A marine hull according to claim 3 further comprising an upwardly and laterally extending baffle within said compartment between the front wall thereof and the transom, said baffle having a relatively small aperture near its upper edge and at least one relatively large aperture below the small aperture.

6. A marine hull according to claim 3 further comprising a bait tank extending into the compartment from the floor, a pick-up conduit extending from the hull bottom to the bait tank, and a drain aperture in the bait tank for discharge of water from the bait tank into the compartment.

7. A marine hull according to claim 3 comprising a plurality of sub-hulls each of which comprises a frontal surface containing said rearwardly diverging channels and a stern end into which said channels open, a propeller and a rudder carried by one of the sub-hulls.

8. A marine hull according to claim 7 wherein the said frontal surface of each said sub-hull is generally conical in shape.

9. A marine hull having a forebody, a transom, and a bottom extending therebetween, the bottom comprising walls defining a plurality of upwardly formed channels arranged in pairs between the forebody and the transom, the channels of each pair diverging in a rearward direction, the upwardly formed pairs of channels including inner and lower channels, and outer and upper channels, air entry means near the forward ends of at least one said pair of channels, some of said channel walls being interrupted by forwardly and rearwardly facing walls, surfaces of some of which define fluid flow paths between the inner and lower channels and adjacent outer and upper channels, the shapes of said surfaces being such that fluid displaced from the inner and lower channels to the adjacent outer and upper channels is directed into the outer and upper channels, the aft ends of at least some of said channels opening at a peripheral edge of said bottom whereby water in those channels is free to discharge therefrom in a rearward and laterally outward direction, and wherein each of said fluid flow paths comprises a forwardly facing wall which approximates the shape of a quarter sphere, and a rearwardly facing wall which is concave in plan.

10. A marine hull according to claim 9 wherein at least one of said channels varies in cross sectional area over its length.

11. A marine hull according to claim 9 comprising a plurality of sub-hulls each of which comprises a frontal surface containing said rearwardly diverging channels and a stern end into which said channels open, a propeller and a rudder carried by one of the sub-hulls.

12. A marine hull having a forebody, a transom, and a bottom extending therebetween, the bottom comprising walls defining a plurality of upwardly formed channels arranged in pairs between the forebody and the transom, the channels of each pair diverging in a rearward direction, the upwardly formed pairs of channels including inner and lower channels, and outer and upper channels, air entry means near the forward ends of at least one said pair of channels, some of said channel walls being interrupted by forwardly and rearwardly facing walls, surfaces of some of which define fluid flow paths between the inner and lower channels and adjacent outer and upper channels, the shapes of said surfaces being such that fluid displaced from the inner and lower channels to the adjacent outer and upper channels is directed into the outer and upper channels, the aft ends of at least some of said channels opening at a peripheral edge of said bottom whereby water in those channels is free to discharge thereform in a rearward and laterally outward direction;

and wherein said bottom comprises a transversely extending upturned wall forward of the transom, a pair of outer side walls, a bottom portion, and a pair of inner side walls adjacent respective said outer side walls, the outer side walls diverging rearwardly in plan and cooperating with respective said inner side walls to form a pair of upwardly formed channels in the bottom portion defining a rearwardly diverging "V" shape in plan opening rearwardly at the transom.

13. A marine hull according to claim 12 wherein at least one of said channels varies in cross sectional area over its length.

14. A marine hull according to claim 12 comprising a plurality of sub-hulls each of which comprises a frontal surface containing said rearwardly diverging channels and a stern end into which said channels open, a propeller and a rudder carried by one of the sub-hulls.

15. A marine hull according to claim 12 wherein the front end of at least one of said upwardly formed channels comprises a discharge aperture, a respective openable hinged flap which closes said discharge aperture, and when opened and the hull is moving at speed, allows a flow of air to discharge into that channel, and means coupled to each said flap and operable to close the said discharge aperture.

16. A marine hull having a forebody, a transom, and a bottom extending therebetween, the bottom comprising walls defining a plurality of pairs of channels between the forebody and the transom, the channels of each pair diverging throughout their lengths in a rearward direction, the forward ends of at least some of the channels being shallower than the after ends thereof;

a first group of fluid flow path walls extending laterally outwardly from at least some of the channels near the forward ends thereof defining fluid flow paths and having such shapes that fluid displaced from beneath the forward end of the hull can move laterally outwardly through the fluid flow paths of the first group;

a second group of flow path walls extending laterally between adjacent channels of at least some of the channels near the rear ends and being of such shape that fluid displaced from inner channels can move laterally outwardly through the flow paths of the second group into respective adjacent outer channels, the aft ends of at least some of the channels opening at a peripheral edge of said bottom whereby water in those channels is free to discharge therefrom in a rearward and laterally outward direction, and wherein at least some of the flow path walls of said first group are notch walls which define notches in the hull, each of which diminishes in size from its forward to its aft ends.

17. A marine hull according to claim 16 wherein said flow path walls of said second group are defined by spaced walls in the hull which extend laterally between adjacent said channels and include forwardly facing walls which are convex in plan and rearwardly facing walls which are concave in plan, thereby defining fluid flow paths of such shape that water is free to flow from inner said channels laterally and to be discharged in a lateral and rearward direction into adjacent outer said channels.

18. A marine hull having a forebody, a transom, and a bottom extending therebetween, the bottom comprising walls defining a plurality of pairs of channels between the forebody and the transom, the channels of each pair diverging throughout their lengths in a rearward direction, the forward ends of at least some of the channels being shallower than the after ends thereof;

a first group of fluid flow path walls extending laterally outwardly from at least some of the channels near the forward ends thereof defining fluid flow paths and having such shapes that fluid displaced from beneath the forward end of the hull can move laterally outwardly through the fluid flow paths of the first group;

a second group of flow path walls extending laterally between adjacent channels of at least some of the channels near the rear ends and being of such shape that fluid displaced from inner channels can move laterally outwardly through the flow paths of the second group into respective adjacent outer channels, the aft ends of at least some of the channels opening at a peripheral edge of said bottom whereby water in those channels is free to discharge therefrom in a rearward and laterally outward direction, and wherein said bottom comprises a transversely extending upturned wall forward of the transom, a pair of outer side walls, a bottom portion, and a pair of inner side walls adjacent respective said outer side walls, the outer side walls diverging rearwardly and cooperating with respective said inner side walls to form a pair of upwardly formed channels in the bottom portion defining a rearwardly diverging "V" shape in plan opening rearwardly at the transom, discharge apertures in respective said upwardly formed channels near their forward ends, respective valves closing said discharge apertures, and respective valve control means coupled to the valves independently operable to open said valves.

* * * * *